US012419397B1

(12) United States Patent
Rizza et al.

(10) Patent No.: US 12,419,397 B1
(45) Date of Patent: Sep. 23, 2025

(54) DISPLAY CASE AND ASSEMBLY

(71) Applicant: Galactic Kraken, LLC, Irvine, CA (US)

(72) Inventors: Ali Adam Rizza, Laguna Niguel, CA (US); Christian Barrera, Lake Elsinore, CA (US)

(73) Assignee: Galactic Kraken, LLC, Irvine, CA (US)

( * ) Notice: Subject to any disclaimer, the term of this patent is extended or adjusted under 35 U.S.C. 154(b) by 0 days.

(21) Appl. No.: 18/770,375

(22) Filed: Jul. 11, 2024

(51) Int. Cl.
*A45C 11/04* (2006.01)
*A47F 7/024* (2006.01)
*A45F 5/00* (2006.01)

(52) U.S. Cl.
CPC ..... *A45C 11/04* (2013.01); *A47F 7/0243* (2013.01); *A45F 5/1541* (2025.01)

(58) Field of Classification Search
CPC ..... A45C 11/04; A47F 7/0234; A45F 5/1541
USPC ..... 206/5, 6
See application file for complete search history.

(56) References Cited

U.S. PATENT DOCUMENTS 4,784,277 A * 11/1988 Wallish ..... A47F 5/112 211/167
5,016,749 A * 5/1991 Kaye ..... A45C 11/046 206/5
2005/0045572 A1* 3/2005 Obstfeld ..... A47F 7/021 211/133.1
2005/0236281 A1* 10/2005 Chao ..... B65D 85/38 206/6
2008/0143678 A1* 6/2008 Sadler ..... G06F 1/163 345/168
2010/0276384 A1* 11/2010 Mak ..... A47G 29/08 211/106.01
2012/0205332 A1* 8/2012 Anderson ..... A47F 7/021 211/85.1
2013/0126453 A1* 5/2013 Flickinger ..... A47G 25/62 211/85.3
2016/0128494 A1* 5/2016 O'Toole ..... G09F 3/204 211/85.1

* cited by examiner

*Primary Examiner* — Jacob K Ackun
(74) *Attorney, Agent, or Firm* — Samareh J. Afrasiabi

(57) ABSTRACT

A display system is provided comprising a display case, a clamshell assembly, and a stand assembly. The display system can be utilized to provide various means to securely showcase and store a collectible product, such as a collectible piece of eyewear, while reducing the need for the user to remove the collectible product from the display system or, alternatively, allowing the user to remove the product from the display system without comprising the value of the collectible product.

20 Claims, 11 Drawing Sheets

DISPLAY CASE AND ASSEMBLY

BACKGROUND OF THE INVENTION

The subject matter described herein relates generally to display cases. In particular, disclosed herein are various embodiments of display cases and assemblies for collectible items and/or consumer products, such as, eyewear, and systems and methods related thereto.

In recent years, the popularity of collecting consumer products has increased. The objects collected range from sports equipment, model cars, toys, game cards, and apparel, such as, eyewear, to name a few. Eyewear fits in a class of collectibles which are desired by both adults and children.

A common sales practice is to combine sale of a product with a novelty item or brand. The consumer attraction to either the product, or novelty item or brand makes the combination more desirable to the consumer.

Collectibles, such as eyewear collectible items (e.g., sunglasses, reading glasses, optical frames, smart glasses, spectacles, etc.) are presently being produced with very detailed and distinctive designs. Most owners of such collectibles store said collectibles in a storage or display case. With today's traditional display cases, the owner of such a collectible must remove the collectible from the case in order to present the collectible's details. This results in a risk of dropping the collectible as well as smearing the collectible with hand and fingerprints, and/or exposing the collectible such that it can collect dust. Removing the collectible from the storage or display can also diminish the value of the collectible.

Display cases are critical to the sales of consumer products as they are the means by which products are positioned in the view and reach of prospective purchasers. Display cases are therefore configured to hold and position as much product as possible in the view of consumers in an orderly and appealing arrangement. There are many display cases disclosed in the prior art. Unfortunately, nearly all such cases obscure at least part of the product displayed therein. Traditionally, display cases for eyewear tend to obscure or block the view of the temples, which can be an important or valuable part of the design and aesthetic. Thus, it would be desirable to provide a display case for presenting a collectible, such as, eyewear, for viewing top and bottom, front and back, and from side to side without the necessity of removing the collectible from the display case. In this manner, the consumer can examine the item from various angles without removing it from the case.

It would also be advantageous to provide a display case, wherein the case itself is the product packaging, and wherein the case itself adds to the desirability and exclusivity of the item. It would be further advantageous to provide a display case which can demonstrate to the consumer how the item (e.g., eyewear) showcased therein would appear when worn by the consumer without the need for removing the item from the case so as to actually be worn, while simultaneously exhibiting the item in a manner such that it can be viewed from multiple angles without obscuration.

It would also be further advantageous to provide a display case with an assembly which adds to the overall uniqueness and collectability of the product, and allows the user to remove the item from the case and alternately display the item on the assembly. In this regard, the item can be removed from the display case and instead arranged on the assembly without compromising the value of the collectible item.

SUMMARY OF THE INVENTION

Aspects of the subject matter described herein are set out in the independent claims and preferred features are set out in the dependent claims. Features associated with one aspect may be applied to other aspects alone or in combination. Provided herein are example embodiments of systems, devices, and methods for displaying and/or storing collectible items and/or consumer products, such as eyewear. Also provided herein are example embodiments of systems, devices, and methods for displaying and/or storing a collectible item and/or consumer product, such as eyewear, wherein the system, device, and/or method for display and/or storing further adds to the novelty or collectability of the item and/or product. Provided herein are example embodiments of systems, devices, and methods for displaying and/or storing a collectible item and/or consumer product, wherein the individual can select whether to display and/or store the item/product within a display case or outside of the display case on a stand assembly, without comprising the value of the collectible item/product. In this manner, the novelty and uniqueness of the display case, stand assembly, and systems devices, and methods related thereto provide the user the freedom to remove a collectible product from a display case while maintaining the product's value. Further, it provides the user the ability to keep the collectible product within the display case while allowing the user to visualize how the item stored therewithin would appear if removed from the display case and placed on the individual themselves, and while further allowing the individual to view the product from various angles. For example, if the collectible product is eyewear, the display case provides the individual a means to visualize how the eyewear would appear on the user, while also allowing the user to view the eyewear from various angles, without requiring the individual to remove the eyewear from the display case.

According to a first aspect of the present disclosure, there is provided a display system for display and storing an eyewear, the display system comprising: a clamshell assembly comprising a base hingedly connected with an upper flap and a lower flap; an insert removably secured between the upper flap and the lower flap, the insert configured to hold the eyewear in a folded position, wherein in the folded position, a longitudinal axis of the eyewear is parallel or substantially parallel relative to a longitudinal axis of the base; a stand assembly comprising a display stand and a mirror, wherein a reflective frontside of the mirror is configured to face a backside of the eyewear, wherein at least a portion of the reflective frontside of the mirror is configured to face a line of sight of an individual; and a display case configured to display and store the eyewear; wherein the clamshell assembly, the insert, and the stand assembly comprising the display stand and the mirror are configured to be removably housed in the display case, and wherein an orientation of the eyewear relative to the display case and the insert is configured to create an illusion that the eyewear is floating or suspended in space when the eyewear is stored in the display case and held on the insert.

The eyewear can be a collectible eyewear product or item. The display case can include artwork or design features that are related to a brand or novelty feature associated with the eyewear such that the display case adds to the collectability of the eyewear displayed in the display case.

In some embodiments, an orientation of the mirror relative to the eyewear and the individual is configured to create an appearance that the individual is wearing the eyewear stored in the display case. The mirror can be made of glass and/or plastic material.

In some embodiments, wherein the insert comprises a first receiving hole configured to receive a first temple of the eyewear and a second receiving hole configured to receive a second temple of the eyewear, and wherein the eyewear is configured to fold at one or more hinges along the first receiving hole and the second receiving hole such that the first temple and the second temple are oriented along a backside of the insert when the insert holds the eyewear in its folded position.

In some embodiments, wherein the stand assembly is configured to be removably housed within the display case in a disassembled or at least partially disassembled configuration.

In some embodiments, wherein the display case comprises a casing, and wherein the mirror is positioned along a rear surface of the casing when the stand assembly is in the disassembled or at least partially disassembled configuration.

In some embodiments, wherein the positioning of the mirror relative to the eyewear is configured to create an appearance that the individual is wearing the eyewear stored in the display case when at least the portion of the reflective frontside of the mirror is facing the line of sight of the individual.

In some embodiments, further comprising a storage unit configured to store at least one or more components of the stand assembly removably housed within the display case, wherein the stand assembly is transparent or clear, and wherein the storage unit is transparent or clear.

In some embodiments, wherein the stand assembly is configured to be assembled, wherein the mirror is configured to be assembled onto the display stand when the stand assembly is assembled, wherein the display stand is configured to hold the eyewear when the stand assembly is assembled.

In some embodiments, wherein the mirror, when assembled onto the display stand, is oriented relative to the eyewear such that the individual can view one or more temples of the eyewear when at least the portion of the reflective frontside of the mirror is facing the line of sight of the individual, and wherein the individual can further view a frame of the eyewear when the eyewear is held on the display stand.

In some embodiments, the display stand can be positioned on a tabletop, a floor, or within the display case when the stand assembly is assembled.

In some embodiments, wherein the mirror, when assembled onto the display stand, is oriented relative to the eyewear to create an appearance that the individual is wearing the eyewear held on the display stand when the stand assembly is assembled and when the display stand is positioned within the display case.

In some embodiments, wherein an orientation of the eyewear relative to the display case and the stand assembly is configured to create an illusion that the eyewear is floating or suspended in space when the display stand is positioned within the display case when the stand assembly is assembled.

In some embodiments, wherein an orientation of the eyewear relative to the display case and the stand assembly is configured to create an illusion that the eyewear is floating or suspended in space when the stand assembly is removably housed within the display case in a disassembled or at least partially disassembled configuration.

In some embodiments, wherein an orientation of the eyewear relative to the display case and the mirror is configured to allow the individual to view a top, a bottom, a front, a back, a first side, and a second side of the eyewear without requiring the individual to remove the eyewear from the display case.

In some embodiments, the eyewear comprises at least one of a pair of sunglasses, a pair of reading glasses, a pair of optical frames, a pair of smartglasses, or a pair of spectacles.

In some embodiments, the clamshell assembly is transparent or clear.

In some embodiments, the insert is transparent or clear.

In some embodiments, wherein the insert comprises a sheet with a first receiving hole configured to receive a first temple of the eyewear and a second receiving hole configured to receive a second temple of the eyewear, wherein the insert is further configured to securely hold an entire frame of the eyewear in an upright position along a frontside of the insert.

In some embodiments, the display case comprises a casing with a front surface, wherein the upper flap aligns with a first opaque portion of the front surface such that the first opaque portion obscures the upper flap from being fully visible from an exterior of the display case, wherein the lower flap aligns with a second opaque portion of the front surface such that the second opaque portion obscures the lower flap from being fully visible from the exterior of the display case, and wherein an orientation of the upper flap with the first opaque portion and an orientation of the lower flap with the second opaque portion are configured to create the illusion that the eyewear is floating or suspended in space when the eyewear is stored in the display case and held on the insert.

Other systems, devices, methods, features and advantages of the subject matter described herein will be or will become apparent to one with skill in the art upon examination of the following figures and detailed description. It is intended that all such additional systems, methods, devices, features and advantages be included within this description, be within the scope of the subject matter, and be protected by the accompanying claims.

DETAILED DESCRIPTION OF THE INVENTION

Figure 1:
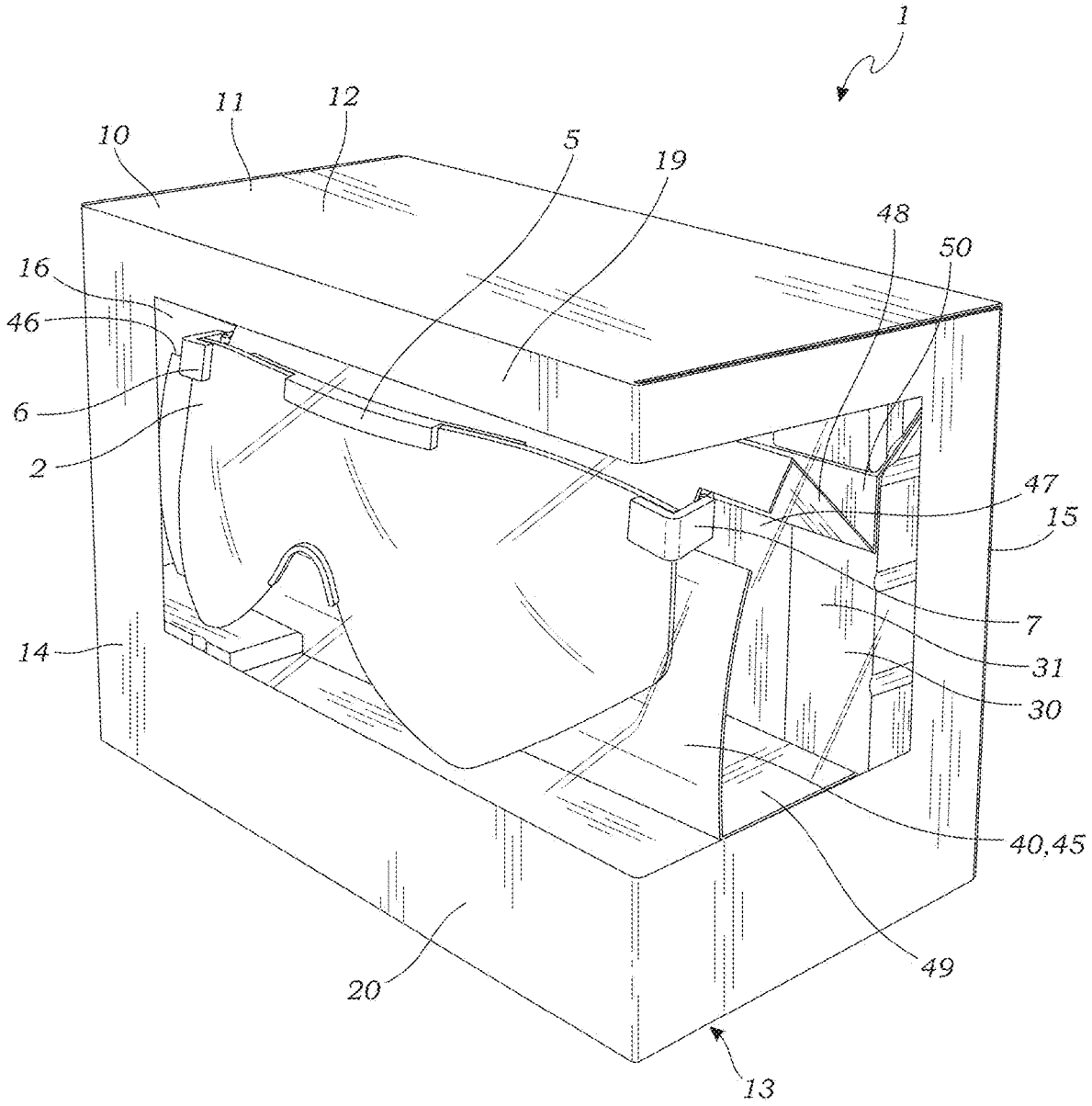
FIG. 1 is a front perspective view of a display system comprising a display case with a clamshell assembly and stand assembly housed therein, illustrating the clamshell assembly holding a product such that it appears to be floating or suspended in space.

While the subject matter described herein is susceptible of embodiment in various forms, as shown in the drawings, hereinafter will be described the presently preferred embodiments of the invention with the understanding that the present disclosure is to be considered as an exemplification of the invention, and it is not intended to limit the invention to the specific embodiments illustrated.

Figure 2:
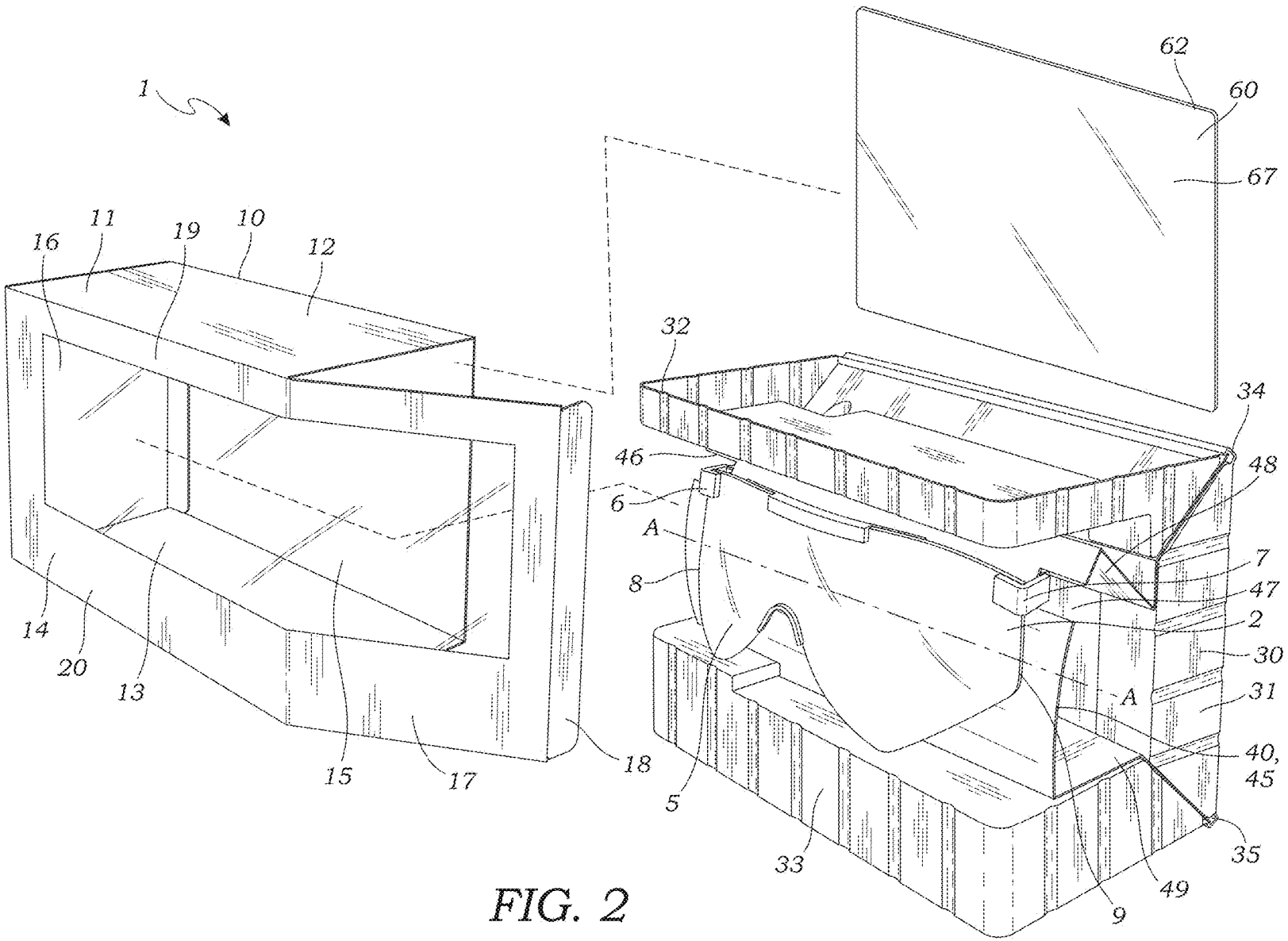
FIG. 2 is partially exploded front perspective view of the display system illustrated in FIG. 1, illustrating the clam shell assembly and the mirror of the stand assembly as it is initially positioned or pre-packaged into the display case.

With reference to FIGS. 1-11, a display system 1 is provided which comprises a display case 10, a clamshell assembly 30 configured to removably hold an object 2 (herein also referred to as a "product" or "item"), and a stand assembly 60 removably disposed within the clamshell assembly 30. According to some embodiments, the clamshell assembly 30 and the stand assembly 60, and/or components thereof, are configured to be removably housed within the display case 10. In some embodiments, the object or product 2 is eyewear 2, including but not limited to a pair of spectacles, a pair of sunglasses, a pair of reading glasses, a pair of optical frames, and a pair of smart glasses. Specifically, the eyewear 2 can be a collectible item such that the display system 1 can be utilized to securely store and display the collectible item for viewing. Those of skill in the art will recognize that other objects or products 2, including but not limited to sports equipment, model cars, toys, game cards, and apparel, can be utilized with the display system without departing from the scope of the present disclosure. Specifically, in some embodiments, the display case 10 is configured to removably and securely store the clamshell assembly 30 and stand assembly 60 therein. More specifically, in some embodiments, the clamshell assembly 30 can be disconfigurable, and the stand assembly 60 can be disassembled or at least partially disassembled when initially packaged and/or removably disposed within the display case 10, or assembled and reinserted into the display case 10 for exhibition, as described in further detail below. For example, as shown in FIG. 2, a mirror 62, which is part of the stand assembly 60 is disassembled from other components of the stand assembly 60 disposed within the display case 10.

With particular reference to FIGS. 1, 2, 6, 7, and 9-11, and according to an aspect of the embodiments, the display case 10 comprises a casing 11 with a top surface 12, a bottom surface 13, a front surface 14, a rear surface 15, a first side surface 16, and a second side surface 17. The display case 10 is configured such that at least part of the display case 10 is transparent so as to allow an individual (also herein referred to as a "user" or "consumer") to view the item 2 stored therein. Specifically, in some embodiments, the front surface 14, or at least part thereof, and at least one of the side surfaces 16 or 17, or at least part thereof, is transparent or partially transparent. In this manner, the user can visualize the item 2 stored within the display case 10. In some embodiments, the front surface 14, the top surface 12, the bottom surface 13, the rear surface 15, and at least one side surface 16 or 17, or parts thereof, are opaque or partially opaque. Those of skill in the art will appreciate that various different surfaces of the display case 10 can be transparent or opaque without departing from the scope of the present disclosure. For example, the front surface 14 and the first side surface 16 and second side surface 17, or at least parts thereof, can be transparent or partially transparent. Further, the top surface 12, rear surface 15 and/or bottom surface 13, or at least parts thereof, can also be transparent or partially transparent. Additionally, various surfaces, or at least parts thereof, of the display case 10 can be opaque so as to provide a canvas for design associated with the object or product 2 disposed therein. For example, the display case 10 can comprise an opaque top surface 12, an opaque bottom surface 13, a partially transparent and partially opaque front surface 14, an opaque rear surface 15, a first side surface 16, and a partially transparent and partially opaque second side surface 17, wherein the opaque portions include artistic or design features which the user can associate with the product 2 and/or brand or novelty feature of the product 2. In this manner, the opaque portions of the display case 10 can be utilized to identify the product 2 stored therein and can further add to the product's 2 novelty and/or collectability. As such, the display case 10 dually functions as a holder for the product 2 and also adds to the novelty of the product 2, thereby making the display system 1 itself a collectible item which can further hold a collectible product 2.

Figure 6:
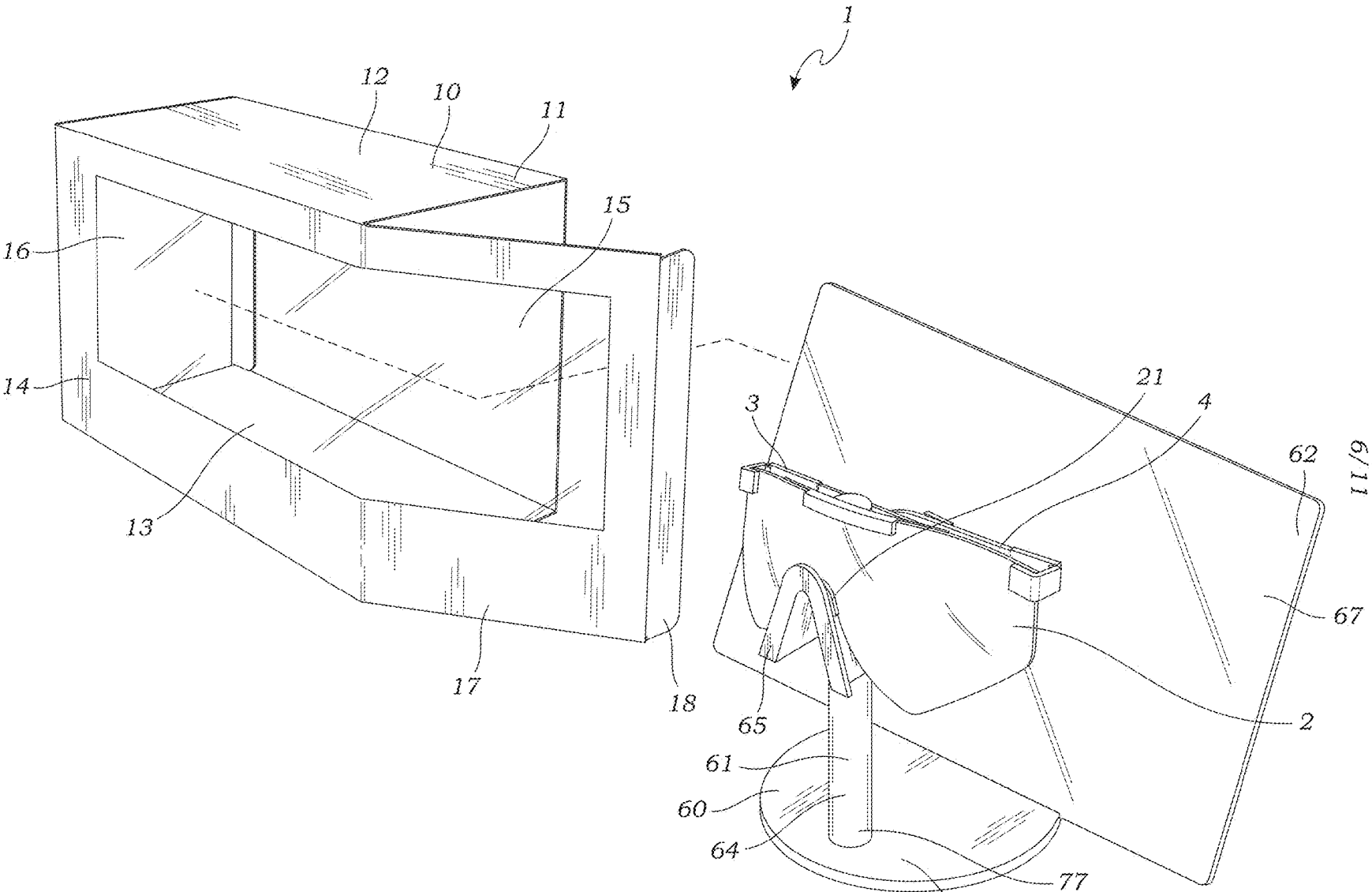
FIG. 6 is a partially exploded view of the display system illustrated in FIG. 1, wherein the stand assembly is assembled and holding a product, and is sized and configured to be housed with the display case.

According to some embodiments, the display case 10 is quadrilateral in shape, as best shown in FIGS. 1, 2, 6, 7, and 9-11. The display case 10 can be rectangular or substantially rectangular in shape. Specifically, the display case 10 is sized and configured so as to removably house and display the product 2, such as eyewear 2 (e.g., sunglasses, reading glasses, smart glasses, spectacles, etc.). More specifically, and as best shown in FIG. 2, the display case 10 is sized and configured so as to removably hold the clamshell assembly 30 comprising the product 2 and the stand assembly 60. Even more specifically, and with particular reference to FIGS. 2 and 6, at least one or more of the first side surface 16 and second side surface 17 can comprise a tuck-end closure 18 so as to form one or more lids of the display case 10. The tuck-end closure 18 of the first side surface 16 and/or the second side surface 17 can include a flap configured to be tucked into the display case 10 and interface with an inner surface of, e.g., the rear surface 15 of the display case 10. In this manner, the first side surface 16 and the second side surface 17 can transition between an opened position and closed position so as to allow the clamshell assembly 30 and/or product 2 to be removed from the display case 10. For example, and as best shown in FIGS. 2 and 6, a second side surface 17 of the display case 10 is in the opened position. Though not illustrated, the first side surface 16 can be in the opened position, as well. Those of skill in the art will appreciate that various other means, including but not limited to a hook and lock feature, glue feature, a tongue lock, a friction fit, a slit lock, flit tops, or the like, can be utilized to allow the first side surface 16 and second side surface 17 to transition between the opened position and closed position.

Figure 3:
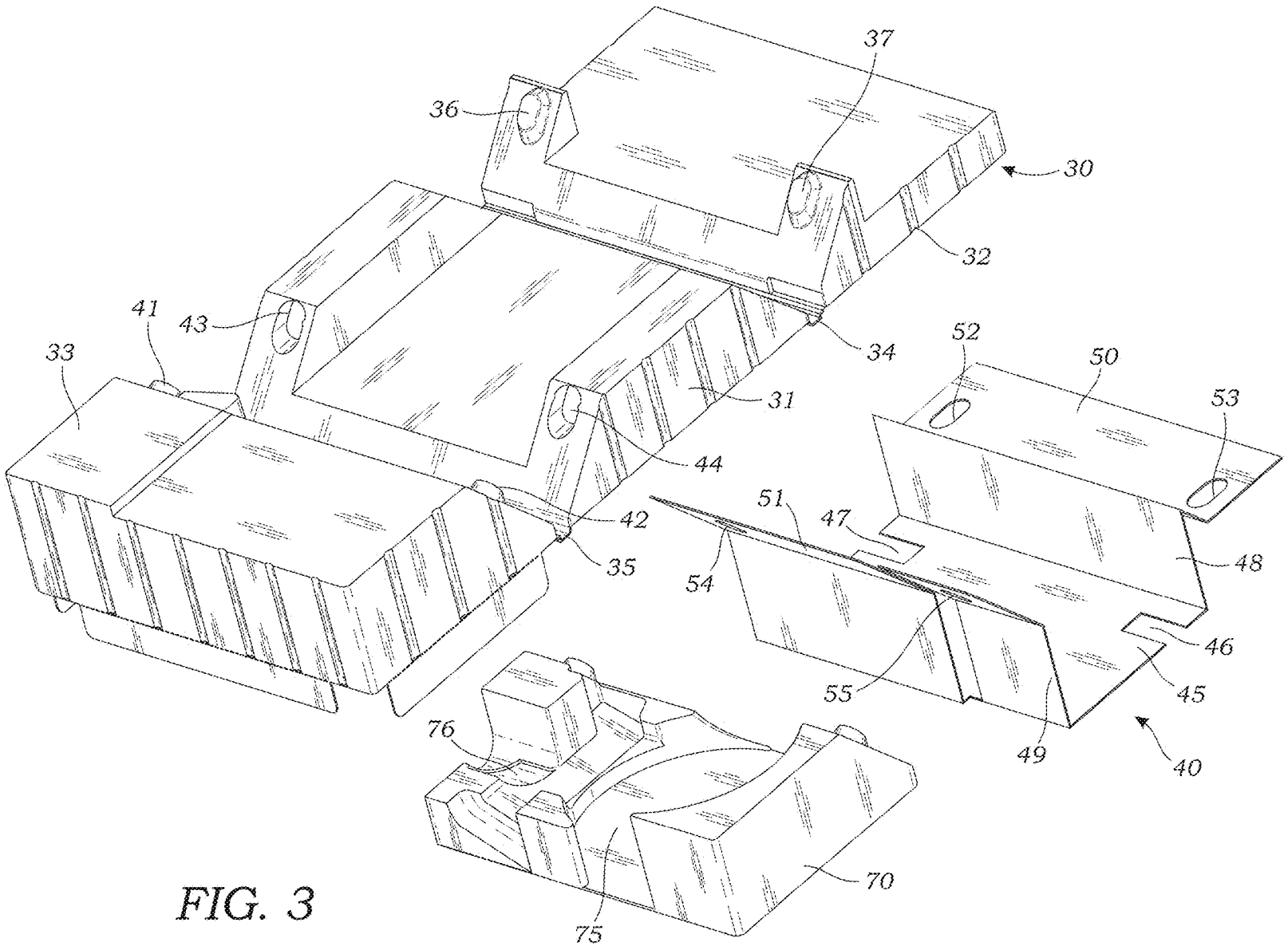
FIG. 3 is a front perspective view of the clamshell assembly, a storage unit, and a protective insert of the display system illustrated in FIG. 1.

With reference to FIGS. 1-4, the display case 10 of the display system 1 can include the clamshell assembly 30. In some embodiments, the clamshell assembly 30 comprises a base 31 hingedly connected with an upper flap 32 and a lower flap 33. Specifically, the base 31 can be connected with the upper flap 32 through a first hinged portion 34, and the lower flap 33 through a second hinged portion 35. In this manner, the clamshell assembly 30 can include a tri-fold, wherein the upper flap 32 folds over the base 31 and the lower flap 33 folds under the base 31. In some embodiments, the first hinged portion 34 and the second hinged portion 35 can each include a living hinge. Further, in some embodiments, and as best shown in FIG. 3, the upper flap 32 can comprise a first nub 36 and a second nub 37 sized and configured to be removably received within a first mating hole (not illustrated in FIG. 3) and a second mating hole (not illustrated in FIG. 3), respectively, of the base 31 along the first hinged portion 34. Additionally, the lower flap 33 can comprise a third nub 41 and a fourth nub 42 sized and configured to be removably received within a third mating hole 43 and a fourth mating hole 44, respectively, of the base 31 along the second hinged portion 35.

Additionally, and with reference to FIGS. 1-4, the clamshell assembly 30 further comprises a protective insert 40 with a sheet 45 configured to hold the product 2, such as the eyewear 2 (e.g., sunglasses, reading glasses, optical frames, smart glasses, spectacles, etc.). Specifically, the sheet 45 can include a first receiving hole or opening 46 and a second receiving hole or opening 47. More specifically, the first receiving hole 46 is sized and configured to receive a first portion of the product 2 and the second receiving hole 47 is sized and configured to receive a second portion of the product 2. For example, the first receiving hole 46 can be sized and configured to receive a first hinge 6 of the eyewear product 2 and the second receiving hole 47 can be sized and configured to receive a second hinge 7 of the eyewear product 2. In this regard, the item 2, such as the eyewear 2, can removably and securely sit on the sheet 45 by at least way of the first receiving hole 46 and second receiving hole 47. Accordingly, the protective insert 40 can be further configured such that an entire frame 5 of the eyewear product 2 is securely held in an upright position along a frontside or sheet 45 of the protective insert 40 when the first hinge 6 is received in the first receiving hole 46 and the second hinge 7 is received in the second receiving hole 47. In this manner, the eyewear product 2 can fold at one or more hinges 6, 7 along the first receiving hole 46 and the second receiving hole 47 such that the first temple 3 and second temple 4 are oriented along a backside of the protective insert 40 when the insert 40 holds the eyewear 2 in the folded position.

Figure 4:
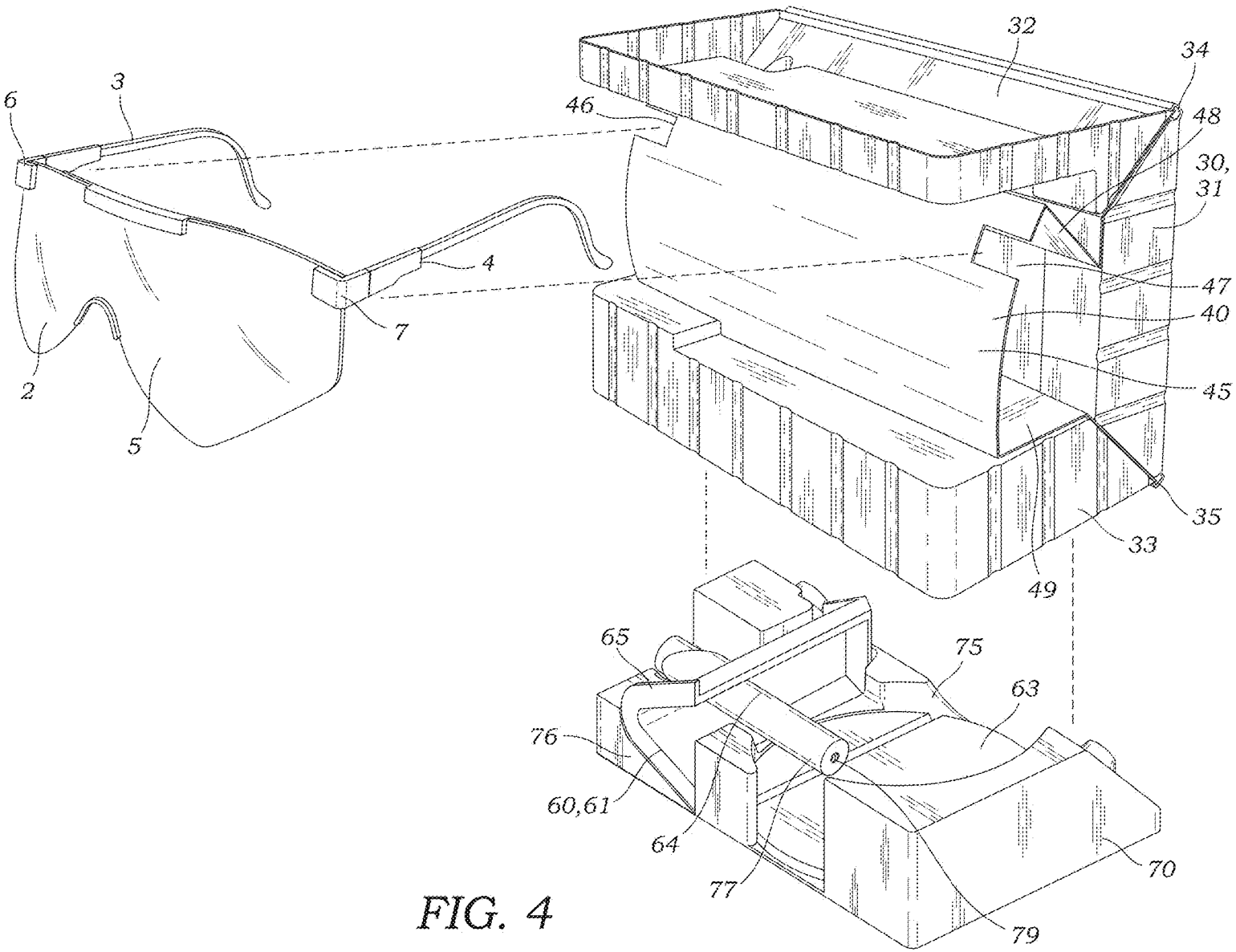
FIG. 4 is a partially exploded front perspective view of the display system illustrated in FIG. 1, illustrating the positioning of the product on the protective insert and the storage unit relative to the clamshell assembly.

Further, in some embodiments, and as best shown in FIG. 1-4, the protective insert 40 comprises a top edge 48 and a bottom edge 49. In some embodiments, the top edge 48 and bottom edge 49 can each extend in a perpendicular or substantially perpendicular direction relative to the frontside or sheet 45 of the protective insert 40. Further, the top edge 48 and the bottom edge 49 can be parallel or substantially parallel relative to one another. According to another aspect of the embodiments, the top edge 48 and bottom edge 49 can be integrated with the sheet 45 so as to form a unitary piece with the protective insert 40. Specifically, the top edge 48 can extend from a top portion of the sheet 45, proximal relative to the frontside, and the bottom edge 49 can extend from a bottom portion of the sheet 45, distal relative to the frontside. Additionally, in some embodiments, the top edge 48 can extend into a first tab 50, and the bottom edge 49 can extend into a second tab 51 (as best shown in FIG. 4).

According to an aspect of the embodiments, the protective insert 40 is removably secured between the upper flap 32 and the lower flap 33 of the clamshell assembly 30. Specifically, and as bests shown in FIG. 4, the first tab 50 can comprise a first slot 52 and a second slot 53, wherein the first slot 52 is sized and configured to be received between the first nub 36 and the first mating hole (not illustrated), and wherein the second slot 53 is sized and configured to be received between the second nub 37 and second mating hole (not illustrated). More specifically, the first slot 52 and the second slot 53 are sized such that the first nub 36 and the second nub 37, respectively, can extend therethrough and be received within the first mating hole and the second mating hole, respectively. Even more specifically, the first tab 50 is sized and configured such that it can extend into or be slidingly received within the first hinged portion 34. In some embodiments, the top edge 48 can comprise a fold that extends into the first tab 50 so as to align the first tab 50 with the first hinged portion 34. In this manner, the protective insert 40 is secured onto the clamshell assembly 30 by the first tab 50 through connection of the first nub 36 and the first mating hole with the first slot 52 secured therebetween, and through connection of the second nub 37 and the second mating hole with the second slot 53 secured therebetween.

In like manner, and as best shown in FIG. 4, the second tab 51 can comprise a third slot 54 and a fourth slot 55, wherein the third slot 54 is sized and configured to be received between the third nub 41 and the third mating hole 43, and wherein the fourth slot 55 is sized and configured to be received between the fourth nub 42 and fourth mating hole 44. More specifically, the third slot 54 and the fourth slot 55 are sized such that the third nub 41 and the fourth nub 42, respectively, can extend through the third slot 54 and fourth slot 55, respectively, and be received within the third mating hole 43 and fourth mating hole 44, respectively. Even more specifically, the second tab 51 is sized and configured such that it can extend into or be slidingly received within the second hinged portion 35. In some embodiments, the bottom edge 49 extends into the second tab 51 so as to align the second tab 51 with the second hinged portion 35. In this manner, the protective insert 40 is removably secured onto the clamshell assembly 30 by the second tab 51 through connection of the third nub 41 and the third mating hole 43 with the third slot 54 secured therebetween, and through connection of the fourth nub 42 and the fourth mating hole 44 with the fourth slot 55 secured therebetween.

Accordingly, the eyewear product 2 seated on the protective insert 40 through the frontside thereof or the sheet 45 can be positioned in an upright or substantially upright position relative to the sheet 45 by way of the first tab 50 and the second tab 51 being securely engaged with the clamshell assembly 30 through the first hinged portion 34 and second hinged portion 35, respectively. Specifically, the eyewear product 2 is held on the sheet 45 of the insert 40 in a folded position. More specifically, the eyewear product 2 is held on the sheet 45 in the folded position such that a longitudinal axis (as illustrated by broken line A in FIG. 2) of the eyewear 2 is parallel or substantially parallel relative to a longitudinal axis of the base 31. Even more specifically, and a best shown in FIG. 2, the longitudinal axis of the eyewear 2, when seated on the sheet 45 in the folded position, extends from a left end 8 of the eyewear 2 to a right end 9 of the eyewear 2 and defines a width of the eyewear 2. The left end 8 can be on the left side of a left lens on the frame 5 of the eyewear 2, and the right end 9 can be on a right side of a right lens on the frame 5. In this manner, the frame 5 of the eyewear product 2 can be fully visible to the individual from a front perspective view of the clamshell assembly 30 and/or display case 10. Additionally, the clamshell assembly 30 and/or insert 40 can be transparent or clear. In this regard, the transparent clamshell assembly 30 and/or transparent insert 40 allow more of the eyewear 2 to be visible to the individual by obscuring less or none of the eyewear 2. According to some embodiments, and as best shown in FIGS. 1,2 and 4, the clamshell assembly 30 is configured to take any shape so as to hold the eyewear product 2. Specifically, the clamshell assembly 30 is configured to encapsulate or partially encapsulate the eyewear product 2 so as to securely store it thereon. Further, and with particular reference to FIGS. 1-2, and 7, an orientation of the eyewear 2 relative to the display case 10 and the insert 40 is configured to create an illusion that the eyewear 2 is floating or suspended in space when the eyewear 2 is stored in the display case 10 and held on the insert 40.

Figure 7:
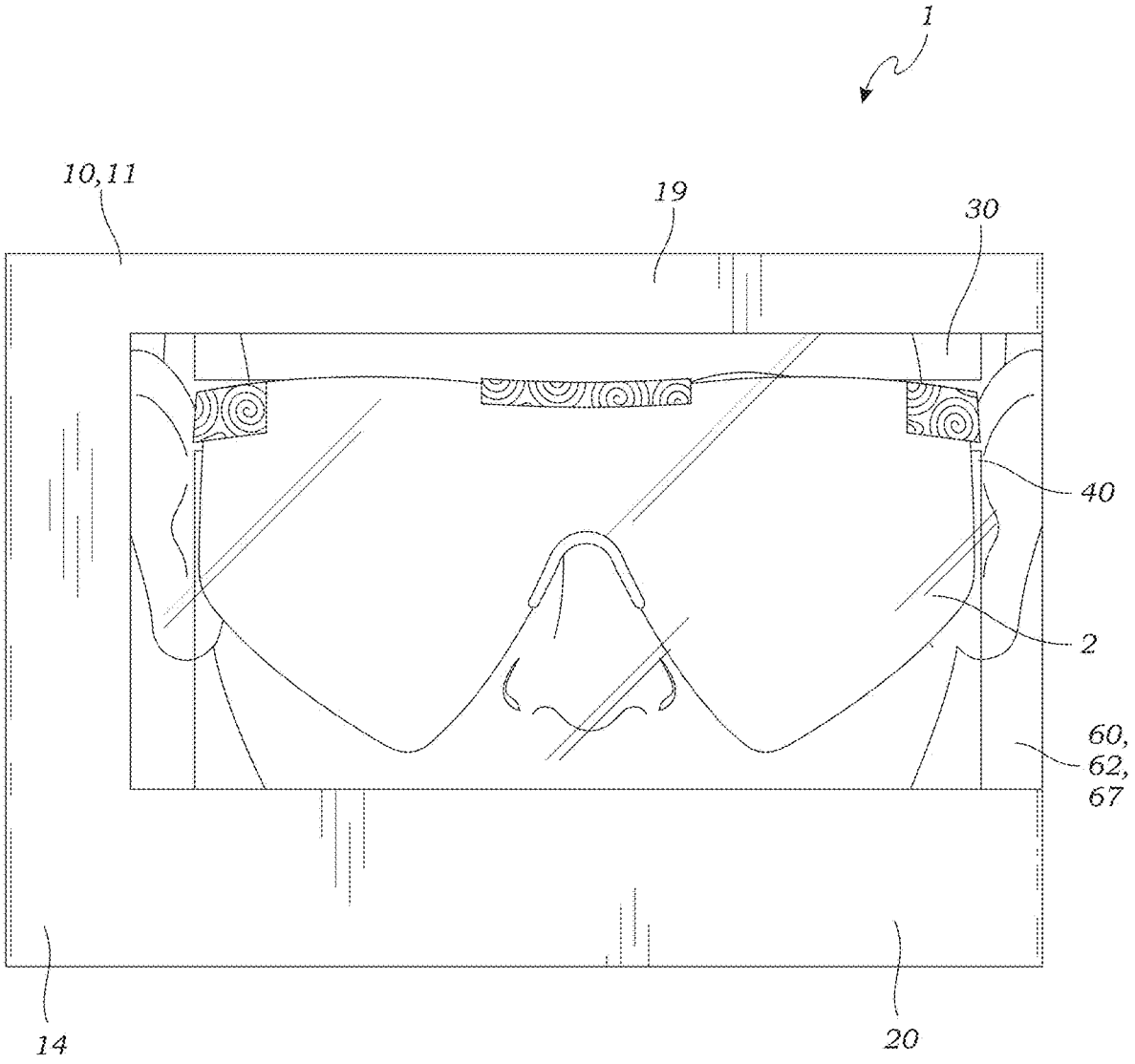
FIG. 7 is a front perspective view of the display system illustrated in FIG. 1, wherein the product is securely held on the clamshell assembly, and wherein the mirror is disposed behind the clamshell assembly and interfacing with a rear surface of the casing of the display case.

In some embodiments, and with reference to FIGS. 1, 2, and 7, the front surface 14 of the display case 10 casing comprises at least a first opaque portion 19 and a second opaque portion 20. Specifically (and as best shown in FIG. 2), the upper flap 32 is configured to align with the first opaque portion 19 such that a length of the upper flap 32 is equal to or less than a length of the first opaque portion 19 so that the edges of the upper flap 32 are not apparent from the exterior of the display case 10. In like manner, the lower flap 33 is configured to align with the second opaque portion 20 such that a length of the lower flap 33 is equal to or less than a length of the second opaque portion 20 so that the edges of the lower flap 33 are not apparent from the exterior of the display case 10. Accordingly, the first opaque portion 19 and the second opaque portion 20 are configured to obscure or partially obscure the upper flap 32 and lower flap 33, respectively, from being fully visible from the exterior of the display case 10, as best seen in FIGS. 1 and 7. As such, the orientation of the upper flap 32 with the first opaque portion 19 and the orientation of the lower flap 33 with the second opaque portion 20 are configured to create or add to an appearance that the eyewear 2 is floating or suspended in space when the eyewear 2 is stored in the display case 10 and held on the protective insert 40.

According to some embodiments, and as best illustrated in FIG. 3, the first tab 50 and the second tab 51 are integrated with the top edge 48 and bottom edge 49, respectively, so as to form a single unitary piece with the protective insert 40. Those of skill in the art will appreciate that various components of the protective insert 40 which are described herein can be formed from different materials or components so as to form the entirety of the protective insert 40 without departing from the scope of the present disclosure.

In some embodiments, the entire clamshell assembly 30 and/or protective insert 40 can be formed from a plastic material, a glass material, polyethylene terephthalate (PET), or the like. The protective insert 40 can be configured so as to be transparent or clear. In this manner, the protective insert 40 adds to the illusion that the eyewear product 2 seated thereon is floating or suspended in space, and offers the consumer/individual the chance to see exactly what the display case 10 is holding and/or what they are purchasing or have purchased. As such, the individual is able to see the eyewear product 2 new and unused without needing to physically manipulate the eyewear product 2 or the display case 10/clamshell assembly 30.

Figure 5:
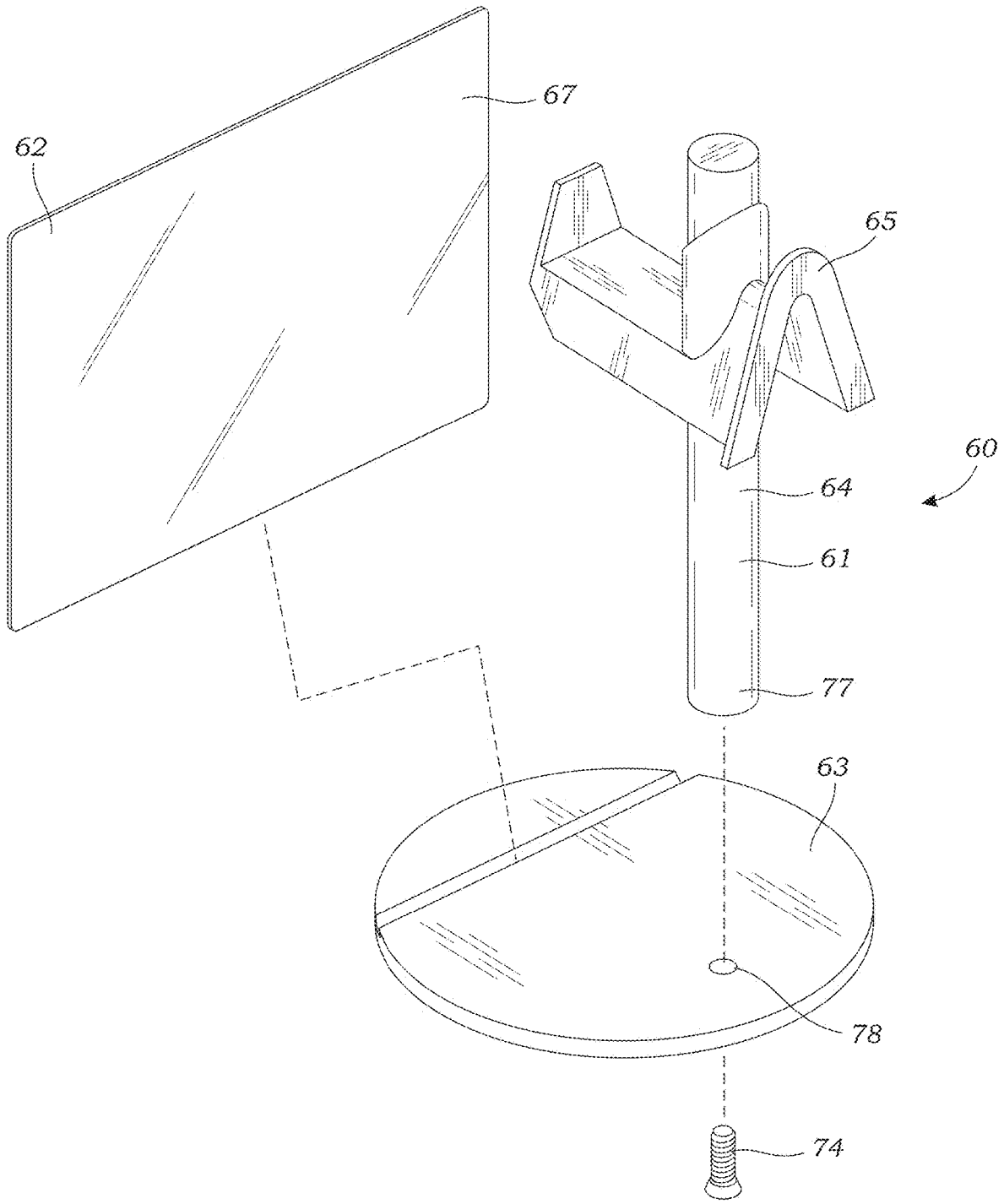
FIG. 5 is an exploded view of the stand assembly for the display system illustrated in FIG. 1, wherein the stand assembly comprises a mirror.

According to some embodiments, and with reference to FIGS. 2, and 4-8, the stand assembly 60 can be initially packaged within the display case or until the user removes the stand assembly 60 or components thereof from the display case 10. Specifically, the stand assembly 60 can be housed within the display case 10 in a disassembled or at least partially disassembled configuration. More specifically, and as best shown in FIG. 5, the stand assembly 60 comprises a display stand 61 with a mirror 62, wherein the components thereof are disassembled or at least partially disassembled from one another. In some embodiments, and as shown in FIG. 6, the stand assembly 60 can be assembled by a user upon being removed from the display case 10 so as to provide an alternate means aside from the display case 10 to display the object 2 (e.g., the eyewear 2). Additionally, and with reference to FIGS. 6, 9-11, the stand assembly 60 can be assembled by a user and positioned within the display case 10 so as to exhibit the object 2 within the display case 10 on the stand assembly 60.

Figure 8:
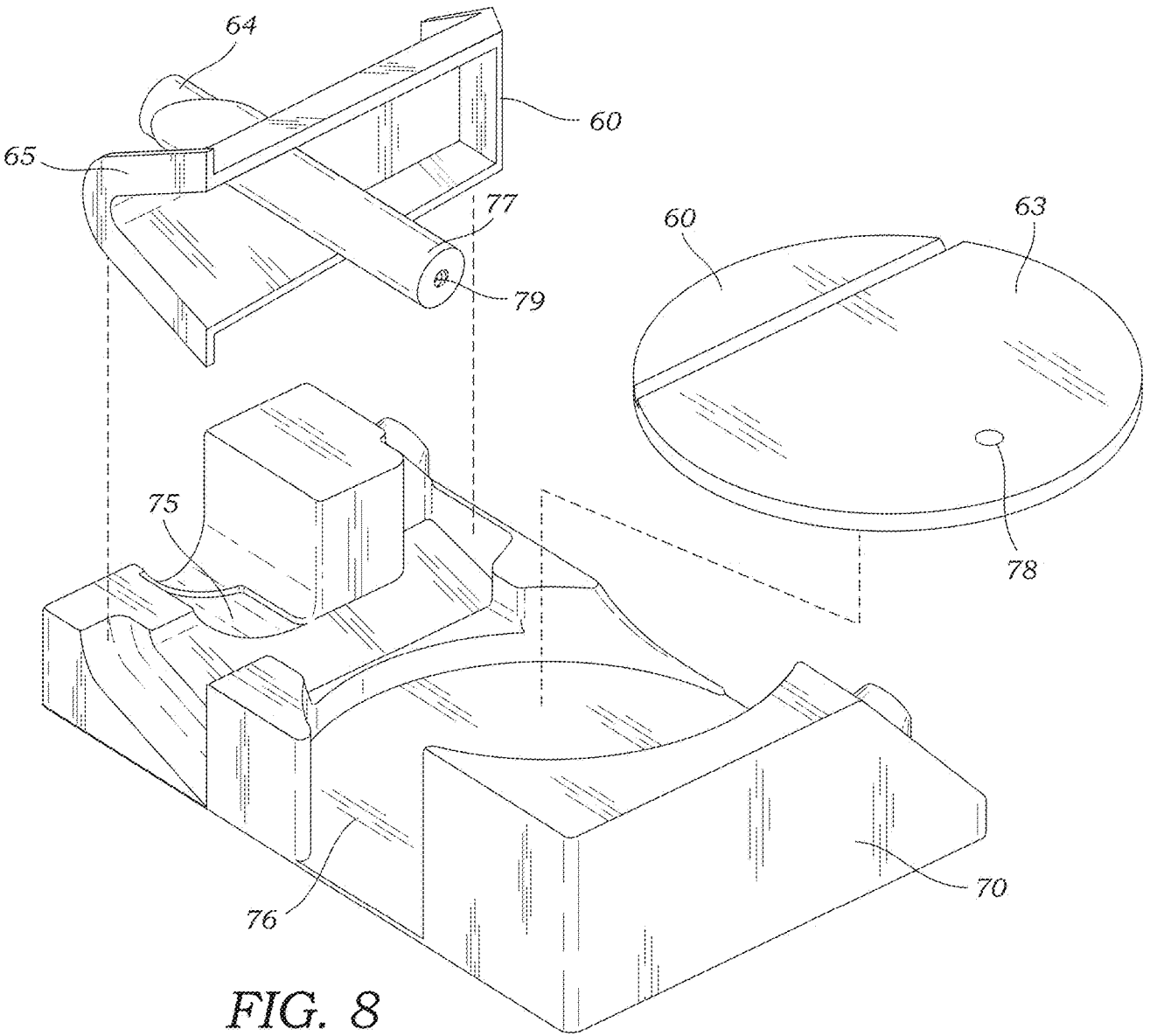
FIG. 8 is an exploded view of a storage unit and a stand assembly for the display system illustrated in FIG. 1, illustrating where the rack with nose piece support and the stand base are configured to be positioned on the storage unit.

In some embodiments, and with reference to FIGS. 4, 5, and 8, the stand assembly 60 can comprise the display stand 61 in a disassembled configuration within the display case 10 (best shown in FIG. 6). Specifically, the display stand 61 comprises one or more components that are configured to be assembled with one another to form the stand assembly 60. More specifically, and as best shown in FIGS. 4-6, and 8, the one or more components comprise a stand base 63, and a rack 64 with a nose piece support 65. The rack 64 and nose piece support 65 can be integrated as one piece or can alternatively be separate pieces configured to be connected together. In some embodiments, the one or more components further comprises the mirror 62. According to some embodiments, and as best shown in FIG. 4, the one or more components can be stored within and/or on the underside the clamshell assembly 30. Specifically, and as shown in FIGS. 3, 4, and 8, the display system 1 can further comprise a storage unit 70 configured to store at least one or more of the one or more components removably housed within the display case 10. More specifically, the storage unit 70 can be positioned underneath the lower flap 33 of the clamshell assembly 30, and can be configured such that the storage unit 70 snaps into or fits into a portion of the lower flap 33 to connect therewith. In some embodiments, the storage unit 70 is transparent or clear such that it is discretely housed within the display case 10. In some embodiments, though not illustrated, the storage unit 70 can comprise a first protrusion and a second protrusion sized and configured to be removably received with a first pocket and a second pocket, respectively, formed on an underside of the lower flap 33. Further, and with reference to FIGS. 3, 4, and 8, the storage unit 70 forms a first cavity 75 sized and configured to securely and removably store the stand base 63, and a second cavity 76 sized and configured to securely and removably store the rack 64 with the nose piece support 65. In this manner, the rack 64 and stand base 63 are securely and discreetly held in place between the lower flap 33 and the storage unit 70 of the display system 1 such that movement of the display system 1 will not manipulate the placement of the rack 64 and stand base 63 held therewithin, and such that the components stored within the storage unit 70 cannot be clearly seen by a user from the outside of the display case 10. Those of skill in the art will appreciate that the storage unit 70 can be positioned in various other locations, including but not limited to above the upper flap 32 of the clamshell assembly 30, without departing from the scope of the present disclosure.

In some embodiments, the rack 64 comprising the nose piece support 65, when stored within the second cavity 76, is configured to overlay or at least partially overlay on the stand base 63 positioned within the first cavity 75 (best shown in FIG. 4). Further, in some embodiments, other fixtures or components can be stored within the storage unit 70. For example, though not illustrated, a cleaning cloth for the eyewear 2, assembly instructions related to the display system 1, and/or a screwdriver configured to threadably engage one or more components of the stand assembly 60 can be stored within the storage unit 70. In some embodiments, the cleaning cloth, assembly instructions, and/or the screwdriver can be stored within the first cavity 75 or can be seated on top of the stand base 63 within the first cavity 75.

According to an aspect of some embodiments, and as shown in FIGS. 4, 5, 6, and 8, a distal end 77 of the rack 64 can be connectable with the stand base 63 so as to form the display stand 61. In some embodiments, the distal end 77 is configured to threadably engage with the stand base 63. Specifically, and as best shown in FIGS. 5 and 8, the stand base 63 can include an aperture 78 sized and configured to receive a screw 74 or a portion thereof (shown in FIG. 5). In this manner, the screw 74 or a portion thereof can extend through the aperture 78 and into the distal end 77 of the rack 64. Specifically, and as best shown in FIGS. 4 and 8, the distal end 77 can comprise a channel 79 with female threads. More specifically, the screw 74 can include a male threaded tip configured to extend through the aperture 78 and into the channel 79 with female threads (not shown) so as to threadably engage the rack 64 with the stand base 63. In some embodiments, the screw 74 is initially threaded into the channel 79, separate and disassembled from the stand base 63 and is threadably removable by the user such that the user can thread the stand base 63 into the rack 64. In this manner, the screw 74 can be stored within the display case 10 by way of being threaded or screwed into the rack 64. Those of skill in the art will appreciate that the screw 74 can be positioned in various other parts of the display system 1 without departing from the scope of the present disclosure.

In other embodiments, though not illustrated, the rack 64 can be attached to the stand base 63 through a snap fit configuration. For example, though not illustrated, the rack 64 can comprise a portion which is sized and configured to snap or click into a corresponding portion of the stand base 63, and/or vice versa. In other embodiments, though not illustrated, the rack 64 can be attached to the stand base 63 via a magnet engagement feature or hook and lock engagement features. Those of skill in the art will appreciate that various other attachment mechanisms can be utilized to attach the stand base 63 with the rack 64 without departing from the scope of the present disclosure. Further, in some embodiments, though not illustrated, the rack 64 with the nose piece support 65 is integrated with the stand base 63 such that no prior assembly is required to attach the components together. In some embodiments, though not illustrated, the display stand 61 can be pre-assembled and foldable such that it can be more efficiently stored within the display case 10.

Specifically, and as best shown in FIGS. 5, 6, and 9-11, the rack 64 can be a rod 64 which includes the nose piece support 65 such that the object 2 (e.g., the eyewear 2) can securely be disposed thereon. More specifically, and as best shown in FIGS. 6, and 9-11, the eyewear 2 can be seated in an upright or substantially upright position while folded on the nose piece support 65. Even more specifically, and as best shown in FIG. 6, the nose piece support 65 is configured to support a nose piece 21 of the eyewear 2 while the temples 3, 4 of the eyewear 2 rest on a temple rest of the rack 64. In some embodiments, the display stand 61 can be transparent or clear. In this regard, the display stand 61 is configured to exhibit the eyewear 2 such that it is unobscured by the display stand 61. The display stand 61 is configured such that it can securely be positioned on a tabletop, a floor, within the display case 10, or other surface by way of the stand base 63 when assembled.

In some embodiments, and with reference to FIGS. 4-6, and 8, the stand base 63 can be round, triangular, hexagonal, octagonal, or quadrilateral in shape. Those of skill in the art will appreciate that various stand base 63 shapes can be utilized without departing from the scope of the present disclosure. While the display stand 61 described herein is configured to hold and display one object 2, such as the eyewear 2, those of skill in the art will appreciate that display stands 61 configured to hold one or more objects 2 (e.g., one or more eyewear 2) can be utilized without departing from the scope of the present disclosure.

According to yet another aspect of the embodiments, and with reference to FIGS. 2, and 5-7, and 10-11, the stand assembly 60 can further comprise the mirror 62, which can be stored within the display system 1. Specifically, in some embodiments, the mirror 62 is initially or pre-packaged within the display case 10 (best shown in FIG. 7). More specifically, and as best shown in FIGS. 2 and 6, the mirror 62 can be positioned along the rear surface 15 of the casing 11. In some embodiments, and with reference to FIGS. 2 and 7, when the stand assembly 60 is disassembled or at least partially disassembled, or prior to full assembly of the stand assembly 60, the mirror 62 can be inserted or housed within the display case 10 along the interior of the rear surface 15 such that a back of the mirror 62 is interfacing with an interior surface of rear surface 15, and the reflective frontside 67 of the mirror 62 is facing the object 2 within the display case 10 and the front surface 14 of the casing 12 of the display case 10. Specifically, and the mirror 62 is oriented such that a reflective frontside 67 of the mirror 62 is facing a line of sight of the individual. In this regard, and as best shown in FIG. 2, the mirror 62 can be perpendicular or substantially perpendicular relative to the bottom surface 13 of the casing 11 of the display case 10 such that a user visually looking into the display case 10 can see their reflection within the mirror 62 (see FIG. 7). Specifically, the mirror 62 is positioned within the display case 10 and relative to the object 2 positioned therein such that positioning the line of sight of the user (the user facing the display case 10 is not shown in the Figures, only a reflection of the user is shown in FIG. 7) with the display case 10 allows the user to visualize how the object 2, e.g., the eyewear 2, stored within the display case 10 would appear if actually worn by the user (see, e.g., FIG. 7). For example, by positioning the line of sight of the user (the user facing the display case 10 is not shown in the Figures, only a reflection of the user is shown in FIG. 7) with at least a portion of the reflective frontside 67 of the mirror 62 stored in the display case 10, the display system 1 creates or adds to an illusion that the user is wearing or trying on the eyewear 2 stored therein and allows the user to visualize how the eyewear 2 would appear on the user by way of the mirror's 62 reflection. In this manner, the display case 10 provides the user the satisfaction of knowing how the eyewear 2 would appear when worn by the user while also allowing the user to keep the eyewear or object 2 stored within the display case 10. As such, the display case 10 can simultaneously store, e.g., a collectible eyewear 2, while allowing the user to visualize its fit on the user's face without requiring the user to remove the eyewear 2 from the display case 10 and by doing so, diminish or comprise its value.

Figure 10:
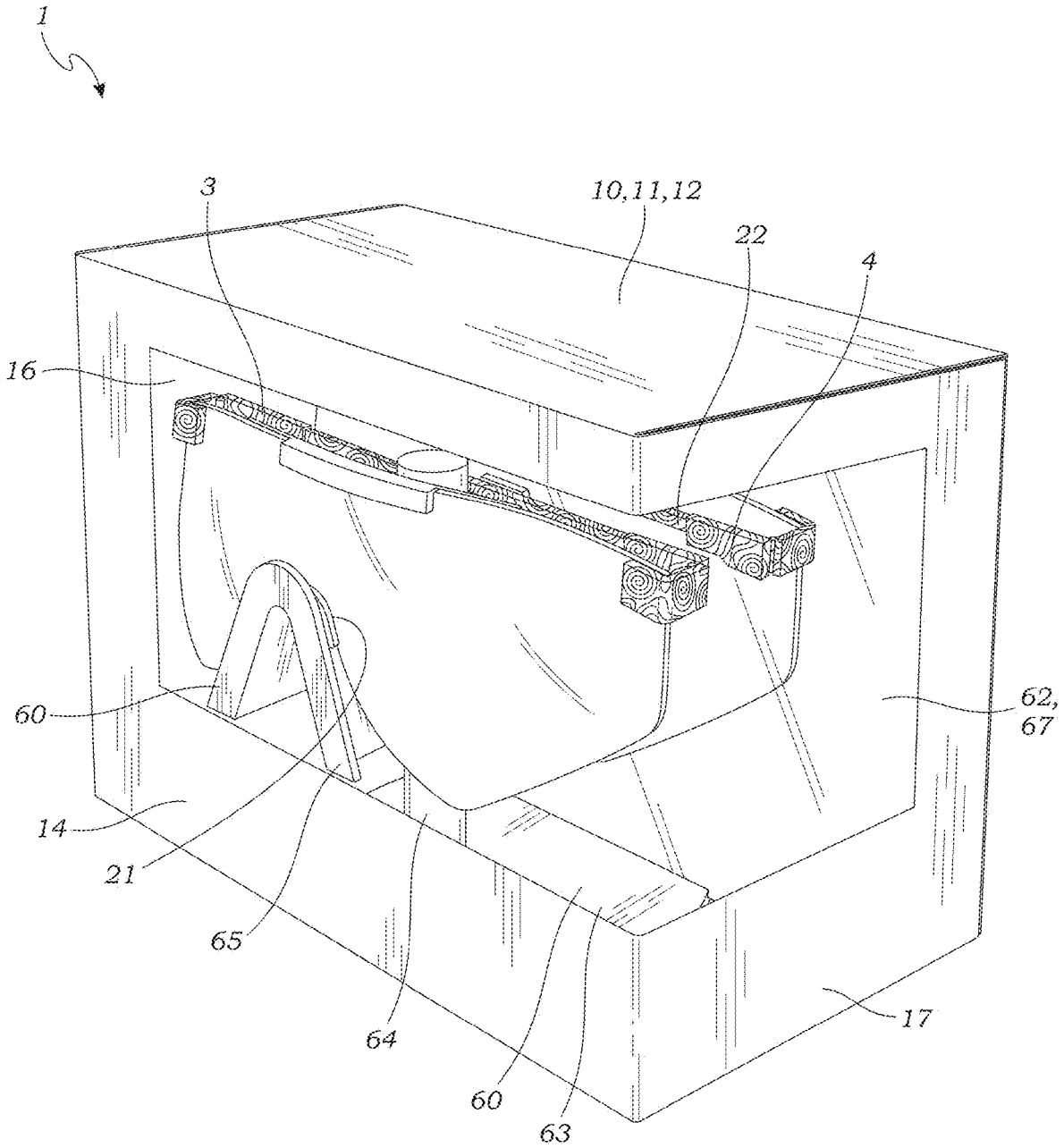
FIG. 10 is a front perspective view of the display system illustrated in FIG. 1, wherein the product is held on the stand assembly, and wherein the stand assembly is assembled with a mirror and disposed within the display case, and wherein a reflection of the backside of the product is visible to a user by way of the mirror's reflection.

Additionally, because of the placement of the mirror 62 relative to the product 2 (e.g., eyewear or collectible eyewear 2) disposed within the display case 10, the user is able to view the product 2 from the front and back without needing to remove the item 2 from the display case 10 (best shown in FIG. 10). For example, the user can view the frame 5 of a particular eyewear 2 disposed in a display case 10, while simultaneously viewing a backside 22 and temples 3, 4 of the particular eyewear 2 through the reflective frontside 67 of the mirror 62 without obscuration or substantial obscuration. Further, the orientation of the eyewear 2 relative to the display case 10 and the stand assembly 60 is configured to create or add to the illusion that the eyewear product 2 is floating or suspended in space. Because of the orientation of the eyewear 2, the mirror 62, the clamshell assembly 30, and the display case 10, the user is able to view the eyewear product 2 disposed in the display case 10 from top and bottom, front and back and from side to side without necessarily requiring the user to remove the product 2 from the display case 10.

Figure 11:
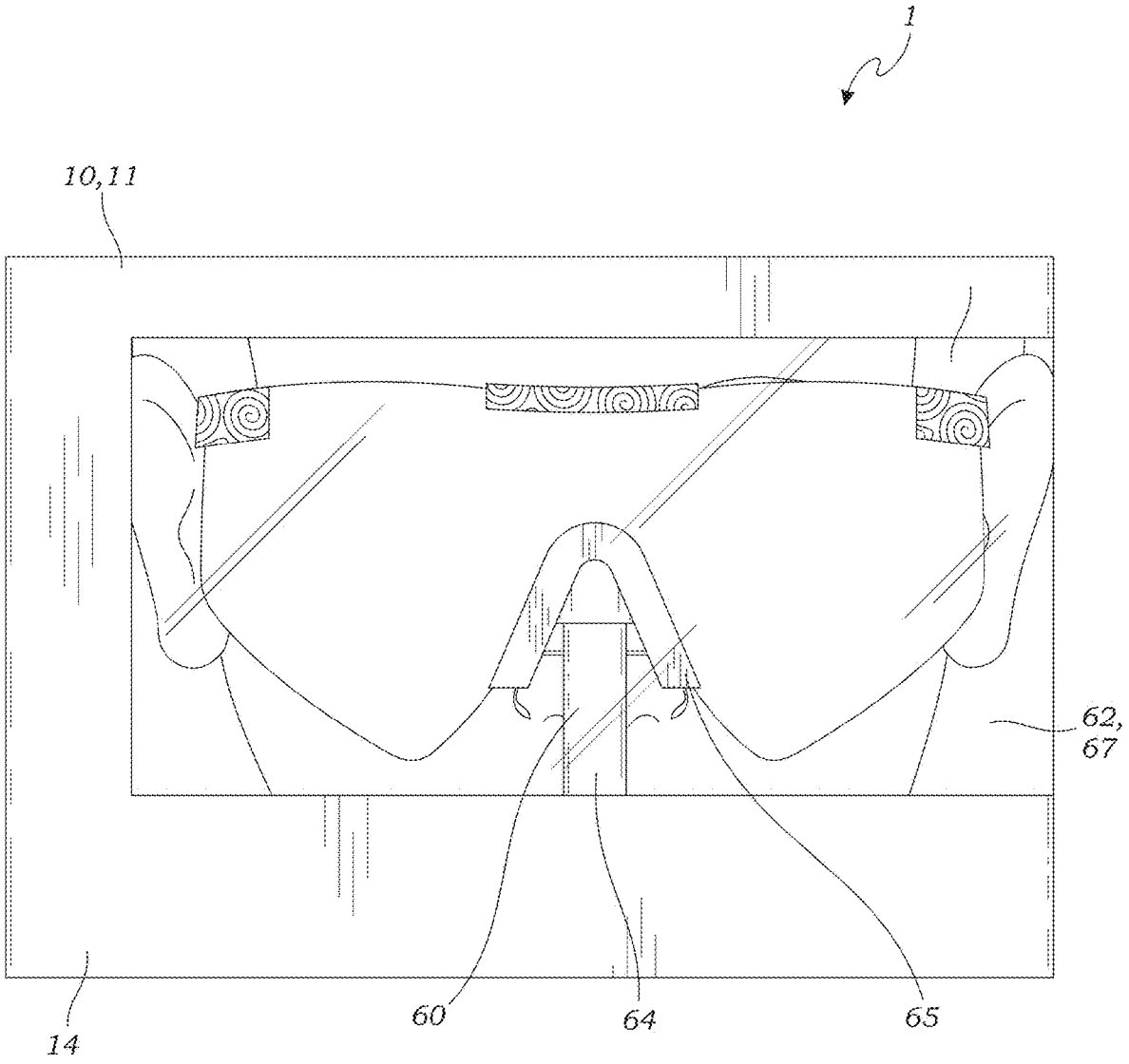
FIG. 11 is a front perspective view of the display system illustrated in FIG. 1, wherein the product is held on the stand assembly, and wherein the stand assembly is assembled with a mirror and disposed within the display case, and wherein a user's line of sight is facing at least a portion of the reflective side of the mirror such that the display system creates an illusion that the user is wearing or trying on the product stored in the display case.

Further, and with reference to FIGS. 5-7, and 10-11, in some embodiments, the mirror 62 can be assembled on the stand assembly 60. In particular, the stand base 63 can comprise a slit 68 (best shown in FIG. 5) sized and configured to receive an edge of the mirror 62. In this regard, the mirror 62 can securely stand or be positioned on the stand base 63 of the stand assembly 60. Specifically, the slit 68 can be positioned on the stand base 63 such that the mirror 62 held thereon is oriented behind the rack 64 with nose piece support 65 when the rack 64 is assembled onto the stand assembly 60. In some embodiments, the mirror 62 can be oriented such that it is perpendicular or substantially perpendicular relative to the stand base 63 or, alternatively, slanted at an angle relative to the stand base 63 (as shown in FIG. 6). Specifically, the mirror 62 when assembled on the stand assembly 60, is configured such that the user can simultaneous view themselves along with the object 2 seated on the stand assembly 60. In some embodiments, the mirror 62 when assembled on the stand assembly 60, is configured such that the user can visualize how the object 2, e.g., the eyewear 2, seated on the stand assembly 60 would appear if actually worn by the user. For example, by positioning the line of sight of the user with the mirror 62 assembled onto the stand assembly 60, the user is able to visualize how the eyewear 2 seated on the display stand 61 of the stand assembly 60 would appear on their face, or at least view their face in addition to the eyewear 2, by way of reflection of the mirror 62, and the orientation of the components of the stand assembly 60 relative to the mirror 62 (see, e.g., FIGS. 10-11; the user facing the display case 10 is not shown in the Figures, only a reflection of the user is shown in FIG. 10-11). Further, in some embodiments, the mirror 62 when assembled on the stand assembly 60, is oriented relative to the eyewear 2 positioned on the stand assembly 60 such that the individual can view one or more of the temples 3, 4 of the eyewear 2 when at least a portion of the reflective frontside 67 of the mirror 62 is facing the line of sight of the individual, while simultaneously viewing a frame 5 of the eyewear 2 by looking at the eyewear 2 on the display stand 61 (best shown in FIG. 10).

In some embodiments, and with reference to FIGS. 2, 5-7, and 10-11 the mirror 62 is rectangular in shape. Specifically, the mirror 62 can be configured such that it corresponds to or is smaller than the size and shape of the rear surface 15 of the casing 11 of display case 10 such that it can be stored therein. In other embodiments, the mirror can be in shape. In some embodiments, the mirror can be curved. In some embodiments, the mirror 62 can be shaped such that it relates to a theme and/or novelty feature or brand of the object 2 stored within the display case 10. In this manner, the mirror 62 itself can further add to the uniqueness, novelty, and collectability of the collectible item 2.

According to yet another aspect of the embodiments, and with reference to FIGS. 6, and 9-11, the stand assembly 60 can be sized and configured such that it can be positioned within the display case 10 when assembled. For example, the stand assembly 60 can be housed within the display case 10 while comprising the mirror 62 positioned on the slit 68 and the object 2, e.g., the eyewear 2, positioned the nose piece support 65 of the display stand 61. In this manner, the mirror 61 is positioned within the display case 10 and relative to the eyewear 2 positioned therein such that positioning a line of sight of the user with the display case 10 allows the user to visualize how the eyewear 2 stored on the stand assembly 60 within the display case 10 would appear if actually worn by the user (best shown in FIG. 11). For example, by positioning the line of sight of the user with the display case 10 comprising the assembled stand assembly 60, the display system 1 creates or adds to an illusion that the user is wearing or trying on the eyewear 2 stored therein and allows the user to visualize how the eyewear 2 would appear on the user by way of the mirror's 62 reflection, as best shown in FIG. 11. Further, in some embodiments, the orientation of the eyewear 2 relative to the display case 10 and the stand assembly 60 is configured to create or add to the illusion that the eyewear 2 is floating or suspended in space when the display stand 61 is positioned within the display case 10 when the stand assembly 60 is assembled.

In this manner, the user is provided various means of viewing the product 2 within the display case 10 in a secure fashion. The user can view the product 2 stored in the display case 10 in various orderly and appealing arrangements, while also reducing the risk of dropping the product 2 by allowing the product to be securely stored in the display case 10 while simultaneously showcasing the aesthetics, artistic features, and details of the product 2 stored therein for the user.

In some embodiments, the stand assembly 60 or portions thereof, can be formed from a plastic material, a glass material, polyethylene terephthalate (PET), or the like. The stand assembly 60 can be configured so as to be transparent or clear. In this manner, the stand assembly 60 creates or add to the illusion that the eyewear product 2 seated thereon is floating or suspended in space, and offers the consumer/individual the chance to see exactly what the display case 10 is holding and/or what they are purchasing or have purchased. As such, the individual is able to see the eyewear product 2 without needing to physically manipulate the eyewear product 2 or the display case 10/stand assembly 60.

Figure 9:
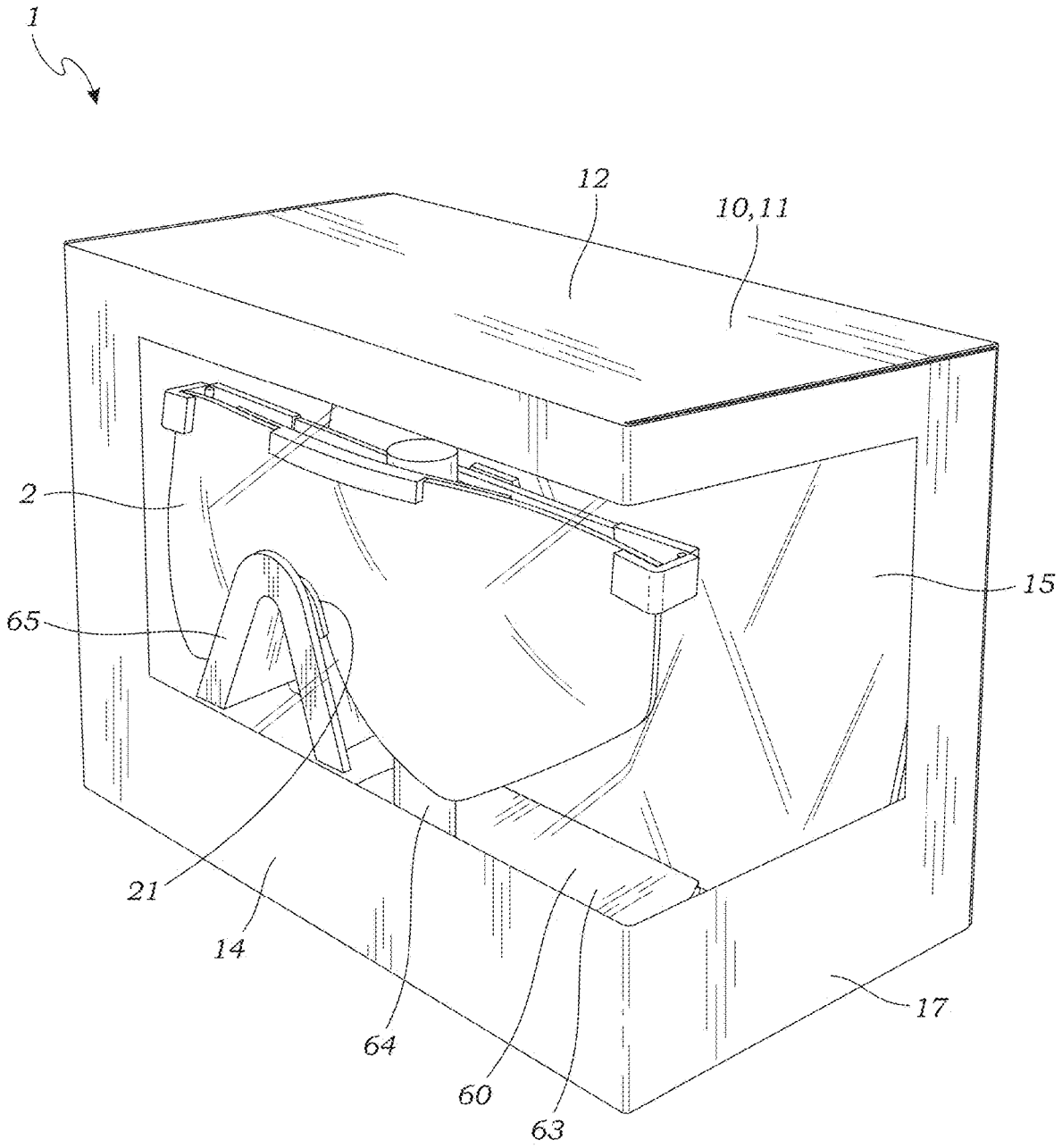
FIG. 9 is a front perspective view of the display system illustrated in FIG. 1, wherein the product is held on the stand assembly, and wherein the stand assembly is assembled without a mirror and disposed within the display case.

In some embodiments, the user can utilize the stand assembly 60 with the mirror 62 assembled thereon when the product 2 is removed therefrom. As such, the user can use the mirror 62 to try on the eyewear 2 and view the eyewear 2 as it appears on the user's face by looking in the reflection of the mirror 62. In some embodiments, and as best shown in FIG. 9, the user can utilize the stand assembly 60 without the mirror assembled thereon, wherein the stand assembly 60 is disposed or inserted into the display case 10 so as to display or hold the product 2 or eyewear 2.

It should be noted that all features, elements, components, functions, and steps described with respect to any embodiment provided herein are intended to be freely combinable and substitutable with those from any other embodiment. If a certain feature, element, component, function, or step is described with respect to only one embodiment, then it should be understood that that feature, element, component, function, or step can be used with every other embodiment described herein unless explicitly stated otherwise. This paragraph therefore serves as antecedent basis and written support for the introduction of claims, at any time, that combine features, elements, components, functions, and steps from different embodiments, or that substitute features, elements, components, functions, and steps from one embodiment with those of another, even if the following description does not explicitly state, in a particular instance, that such combinations or substitutions are possible. It is explicitly acknowledged that express recitation of every possible combination and substitution is overly burdensome, especially given that the permissibility of each and every such combination and substitution will be readily recognized by those of ordinary skill in the art.

In many instances, entities are described herein as being coupled to other entities. It should be understood that the terms "coupled" and "connected" (or any of their forms) are used interchangeably herein and, in both cases, are generic to the direct coupling of two entities (without any non-negligible (e.g., parasitic) intervening entities) and the indirect coupling of two entities (with one or more non-negligible intervening entities). Where entities are shown as being directly coupled together, or described as coupled together without description of any intervening entity, it should be understood that those entities can be indirectly coupled together as well unless the context clearly dictates otherwise.

As used herein and in the appended claims, the singular forms "a", "an", and "the" include plural referents unless the context clearly dictates otherwise.

While the embodiments are susceptible to various modifications and alternative forms, specific examples thereof have been shown in the drawings and are herein described in detail. These embodiments are not to be limited to the particular form disclosed, but to the contrary, these embodiments are to cover all modifications, equivalents, and alternatives falling within the spirit of the disclosure. Furthermore, any features, functions, steps, or elements of the embodiments may be recited in or added to the claims, as well as negative limitations that define the scope of the claims by features, functions, steps, or elements that are not within that scope.

What is claimed is:

1. A display system for displaying and storing an eyewear, the display system comprising:

a clamshell assembly comprising a base hingedly connected with an upper flap and a lower flap;

an insert removably secured between the upper flap and the lower flap, the insert configured to hold the eyewear in a folded position, wherein in the folded position, a longitudinal axis of the eyewear is parallel or substantially parallel relative to a longitudinal axis of the base;

a stand assembly comprising a display stand and a mirror, wherein a reflective frontside of the mirror is configured to face a backside of the eyewear, wherein at least a portion of the reflective frontside of the mirror is configured to face a line of sight of an individual; and a display case configured to display and store the eyewear;

wherein the clamshell assembly, the insert, and the stand assembly comprising the display stand and the mirror are configured to be removably housed in the display case, and wherein an orientation of the eyewear relative to the display case and the insert is configured to create an illusion that the eyewear is floating or suspended in space when the eyewear is stored in the display case and held on the insert.

2. The display system of claim 1, wherein an orientation of the mirror relative to the eyewear and the individual is configured to create an appearance that the individual is wearing the eyewear stored in the display case.

3. The display system of claim 1, wherein the insert comprises a first receiving hole configured to receive a first temple of the eyewear and a second receiving hole configured to receive a second temple of the eyewear, and wherein the eyewear is configured to fold at one or more hinges along the first receiving hole and the second receiving hole such that the first temple and the second temple are oriented along a backside of the insert when the insert holds the eyewear in its folded position.

4. The display system of claim 1, wherein stand assembly is configured to be removably housed within the display case in a disassembled or at least partially disassembled configuration.

5. The display system of claim 4, wherein the display case comprises a casing, and wherein the mirror is positioned along a rear surface of the casing when the stand assembly is in the disassembled or at least partially disassembled configuration.

6. The display system of claim 5, wherein a positioning of the mirror relative to the eyewear is configured to create an appearance that the individual is wearing the eyewear stored in the display case when at least the portion of the reflective frontside of the mirror is facing the line of sight of the individual.

7. The display system of claim 1, further comprising a storage unit configured to store at least one or more components of the stand assembly removably housed within the display case, wherein the stand assembly is transparent or clear, and wherein the storage unit is transparent or clear.

8. The display system of claim 1, wherein the stand assembly is configured to be assembled, wherein the mirror is configured to be assembled onto the display stand when the stand assembly is assembled, wherein the display stand is configured to hold the eyewear when the stand assembly is assembled.

9. The display system of claim 8, wherein the mirror, when assembled onto the display stand, is oriented relative to the eyewear such that the individual can view one or more temples of the eyewear when at least the portion of the reflective frontside of the mirror is facing the line of sight of the individual, and wherein the individual can further view a frame of the eyewear when the eyewear is held on the display stand.

10. The display system of claim 8, wherein the display stand can be positioned on a tabletop, a floor, or within the display case when the stand assembly is assembled.

11. The display system of claim 10, wherein the mirror, when assembled onto the display stand, is oriented relative to the eyewear to create an appearance that the individual is wearing the eyewear held on the display stand when the stand assembly is assembled and when the display stand is positioned within the display case.

12. The display system of claim 10, wherein an orientation of the eyewear relative to the display case and the stand assembly is configured to create an illusion that the eyewear is floating or suspended in space when the display stand is positioned within the display case when the stand assembly is assembled.

13. The display system of claim 1, wherein an orientation of the eyewear relative to the display case and the stand assembly is configured to create an illusion that the eyewear is floating or suspended in space when the stand assembly is removably housed within the display case in a disassembled or at least partially disassembled configuration.

14. The display system of claim 1, wherein an orientation of the eyewear relative to the display case and the mirror is configured to allow the individual to view a top, a bottom, a front, a back, a first side, and a second side of the eyewear without requiring the individual to remove the eyewear from the display case.

15. The display system of claim 1, wherein the eyewear comprises at least one of a pair of sunglasses, a pair of reading glasses, a pair of optical frames, a pair of smartglasses, or a pair of spectacles.

16. The display system of claim 1, wherein the clamshell assembly is transparent or clear.

17. The display system of claim 1, wherein the insert is transparent or clear.

18. The display system of claim 1, wherein in the folded position, the longitudinal axis of the eyewear extends from a left end of the eyewear to a right end of the eyewear, and wherein the longitudinal axis of the eyewear defines a width of the eyewear in the folded position.

19. The display system of claim 1, wherein the insert comprises a sheet with a first receiving hole configured to receive a first temple of the eyewear and a second receiving hole configured to receive a second temple of the eyewear, wherein the insert is further configured to securely hold an entire frame of the eyewear in an upright position along a frontside of the insert.

20. The display system of claim 1, wherein the display case comprises a casing with a front surface, wherein the upper flap aligns with a first opaque portion of the front surface such that the first opaque portion obscures the upper flap from being fully visible from an exterior of the display case, wherein the lower flap aligns with a second opaque portion of the front surface such that the second opaque portion obscures the lower flap from being fully visible from the exterior of the display case, and wherein an orientation of the upper flap with the first opaque portion and an orientation of the lower flap with the second opaque portion are configured to create the illusion that the eyewear is floating or suspended in space when the eyewear is stored in the display case and held on the insert.

* * * * *